US005423193A

United States Patent [19]

Claterbos et al.

[11] Patent Number: 5,423,193

[45] Date of Patent: Jun. 13, 1995

[54] LOW-MAINTENANCE SYSTEM FOR MAINTAINING A CARGO IN A REFRIGERATED CONDITION OVER AN EXTENDED DURATION

[76] Inventors: John K. Claterbos, 240 SW. Cedar, Warrenton, Oreg. 97146; Stephen C. Fulton, 3168 Harrison Dr., Astoria, Oreg. 97103

[21] Appl. No.: 217,330

[22] Filed: Mar. 23, 1994

[51] Int. Cl.[6] ..... F25D 3/12

[52] U.S. Cl. ..... 62/384; 62/239

[58] Field of Search ..... 62/384, 388, 239

[56] References Cited

U.S. PATENT DOCUMENTS

| | | | |
|---|---|---|---|
| 2,508,385 | 5/1950 | Hall . | |
| 3,206,946 | 8/1965 | Lindersmith et al. . | |
| 3,561,226 | 2/1971 | Rubin . | |
| 4,498,306 | 2/1985 | Tyree, Jr. . | |
| 4,502,293 | 2/1985 | Franklin, Jr. . | |
| 4,593,536 | 6/1986 | Fink et al. . | |
| 4,704,876 | 11/1987 | Hill . | |
| 4,761,969 | 8/1988 | Moe . | |
| 4,766,732 | 8/1988 | Rubin . | |
| 4,825,666 | 5/1989 | Saia, III . | |
| 4,891,954 | 1/1990 | Thomsen . | |
| 4,951,479 | 8/1990 | Araquistain et al. | 62/384 |
| 5,168,717 | 12/1992 | Mowatt-Larssen . | |

OTHER PUBLICATIONS

American Frozen Food Institute, "Cryogenic Railcar Project, Executive Summary Report," Mar. 1985.

*Primary Examiner*—Ronald C. Capossela

*Attorney, Agent, or Firm*—Chernoff, Vilhauer, McClung & Stenzel

[57] ABSTRACT

A system for maintaining a cargo in a refrigerated condition over an extended duration employs an insulated enclosure having both a cargo-enclosing portion and a carbon dioxide-enclosing portion separated by an insulated barrier. A finite amount of solid carbon dioxide is placed in the carbon dioxide-enclosing portion at the beginning of the duration. By properly insulating the barrier to provide a rate of heat transfer within a predetermined range, the cargo is maintained in a refrigerated condition without replenishing the solid carbondioxide for uniquely lengthy durations. Such durations are especially maximized by employing such enclosures in the form of cargo-carrying containers of generally rectangular shape stackable vertically atop one another and/or in close side-by-side relation to one another.

10 Claims, 5 Drawing Sheets

LOW-MAINTENANCE SYSTEM FOR MAINTAINING A CARGO IN A REFRIGERATED CONDITION OVER AN EXTENDED DURATION

BACKGROUND OF THE INVENTION

This invention relates to systems for maintaining a cargo in a refrigerated condition over an extended duration by means of a finite amount of solid carbon dioxide which is not replenished during such duration.

It has long been the practice to refrigerate items in an insulated enclosure by placing solid carbon dioxide either directly into the storage area of the enclosure or into a separate compartment adjacent to the storage area. Such systems are shown, for example, in the following publications:

U.S. Pat. No. 2,508,385
U.S. Pat. No. 3,206,946
U.S. Pat. No. 3,561,226
U.S. Pat. No. 4,498,306
U.S. Pat. No. 4,502,293
U.S. Pat. No. 4,593,536
U.S. Pat. No. 4,704,876
U.S. Pat. No. 4,761,969
U.S. Pat. No. 4,766,732
U.S. Pat. No. 4,825,666
U.S. Pat. No. 4,891,954
U.S. Pat. No. 5,168,717
American Frozen Food Institute, "Cryogenic Railcar Project, Executive Summary Report," March 1985.

The foregoing systems have been especially applicable for shipment of refrigerated items by railcar where a finite amount of solid carbon dioxide is placed in a bunker at the top of the railcar prior to shipment and gradually receives heat through the bunker floor from the cargo, and through the railcar roof from the surrounding environment, which converts the solid carbon dioxide to a gas by the process of sublimation. The gas is vented from the bunker into the cargo area where it circulates to cool the cargo and then is exhausted to the atmosphere. In such systems, as exemplified by the above-listed U.S. Pat. Nos. 4,502,293, 4,593,536, 4,704,876, and 4,761,969, it has been a common practice to insulate the floor of the carbon dioxide-containing bunker to limit the heat transfer directly from the cargo to the carbon dioxide to avoid overcooling of the cargo. This, together with the heavy steel construction of the railcar which functions advantageously as a heat sink, has had the effect of extending the period during which the cargo can be maintained in a refrigerated condition without replenishing the carbon dioxide to durations of as much as 12 to 15 days, with carbon dioxide sublimation occurring over a substantially shorter period (until exhaustion of the solid carbon dioxide) followed by gradual warming of the cargo. A railcar modified and used commercially in 1991 by the present inventor, for example, was capable of maintaining adequate refrigeration of a cargo over a 12-day duration employing a carbon dioxide bunker floor which, although insulated, provided a heat transfer rate greater than 0.08 BTU per hour per square foot per degree Fahrenheit of temperature difference between the top and bottom of the bunker floor. This caused exhaustion of the solid carbon dioxide after seven to nine days, depending on the ambient temperature, followed by gradual warming of the cargo.

What has not previously been accomplished nor considered feasible is the attainment of significantly longer refrigeration durations utilizing a finite, nonreplenished amount of solid carbon dioxide, and not necessitating the heavy steel heat sink characteristics of a railcar to achieve such durations. Nevertheless there is a great need for such a low-maintenance refrigeration system for longer-duration shipments, particularly transoceanic shipments.

SUMMARY OF THE INVENTION

The present invention provides a system for maintaining a cargo in a refrigerated condition over extended durations, preferably 30 days or more, utilizing a finite amount of solid carbon dioxide initially placed in a carbon dioxide-enclosing portion of an insulated enclosure separated from a cargo-enclosing portion by an insulated barrier so that sublimation occurs over a duration of at least 15 days. Although it is within the scope of the invention to employ it in railcars, the invention is even more advantageously employed in stackable cargo-carrying containers of much lighter construction than railcars and having significantly less heat sink capacity. Such exceptionally lengthy refrigeration durations are unique for a system of this type, requiring no external power or replenishment of the carbon dioxide during shipment, and are sufficient to accommodate not only normal transoceanic transport times but also loading and unloading delays likely to occur at the origin and destination points, respectively.

The present invention recognizes that achieving such lengthy refrigeration durations in nonreplenished carbon dioxide systems requires a more highly-insulated barrier, separating the carbon dioxide-enclosing portion of the enclosure from the cargo-enclosing portion, than has been considered appropriate in the past, while nevertheless limiting the insulation of the barrier so that it is not excessive. In accordance with the present invention, the insulation of the barrier should be such as to provide a rate of heat transfer across the barrier greater than the rate at which heat is transferred from the cargo to the carbon dioxide gas vented into the cargo-containing portion of the enclosure after initial placement of the solid carbon dioxide has been completed, but no greater than 0.08 BTU per hour per square foot per degree Fahrenheit of temperature difference between the opposite sides of the barrier. Rates of heat transfer below this range, due to excessive insulation, are likely to provide insufficient cooling of the cargo by the carbon dioxide, while rates of heat transfer above this range, due to insufficient insulation, are likely to refrigerate the cargo for too short a duration due to an excessive rate of sublimation of the carbon dioxide.

The present invention also recognizes that finite, nonreplenished carbon dioxide refrigeration systems are capable of obtaining such lengthy refrigeration durations especially if employed in vertically-stackable cargo-carrying containers, as opposed to nonstackable transporting enclosures such as railcars. Normally, a large proportion of the refrigeration capacity of the solid carbon dioxide in a railcar is wastefully expended by the absorption of heat from the environment into the carbon dioxide enclosure through the roof of the railcar. However if stackable containers are used, such wasteful absorption of heat through the roofs is greatly reduced by thermal shielding of the roofs due to stacking. Even in the topmost container having an exposed roof, the wasteful heat absorption is nevertheless at least partially offset by lesser heat absorption through the floor of the container due to the shielding provided by another refrigerated container immediately below it. Similarly, such stackable containers can further limit heat absorption from the environment through their sides and ends by their ability to be arranged in very close side-by-side proximity to one another, thereby further maximizing the durations of refrigeration which are obtainable.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 8:
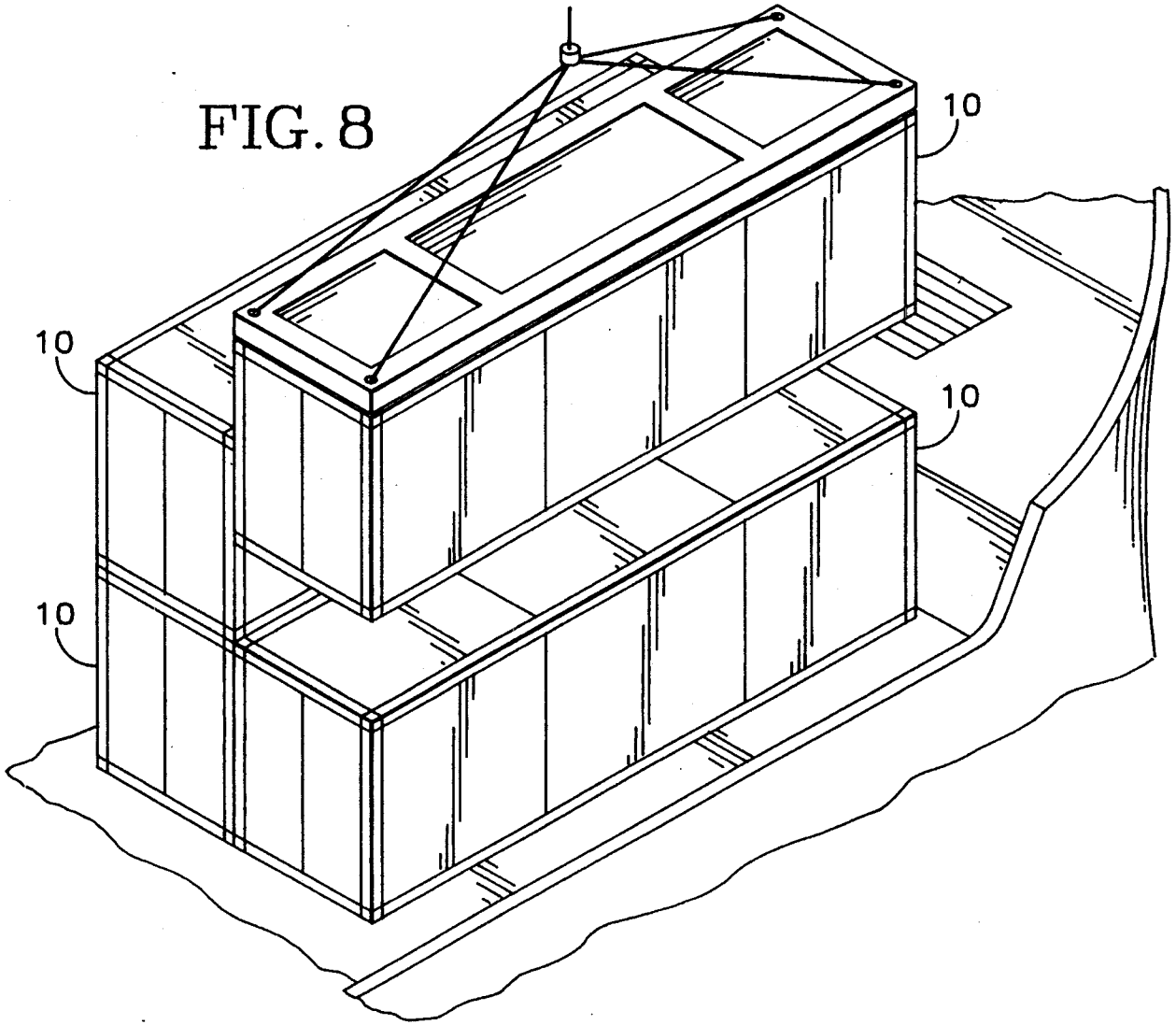
FIG. 8 is a partial perspective view of multiple containers of the type shown in FIG. 1 being loaded onto the deck of a ship.

An exemplary embodiment of a container suitable for use in the present invention, indicated generally as 10, comprises an elongate, generally rectangular enclosure having a top 12, bottom 14, sides 16, permanently closed end 18 and openable end 20 having doors 22. Posts such as 24 are spaced longitudinally along the container to provide not only vertical support for the top 12 but support for enabling multiple containers 10 to be stacked atop one another as depicted in FIG. 8. When stacked vertically, or in side-by-side or end-to-end relationship, conventional locking members 26 can be used to fasten the respective containers to one another for stability. Although the size of the container may be variable, the exemplary container 10 is of a standard 40-foot length with an exterior height of 9½ feet and an exterior width of 8 feet.

Figure 5:
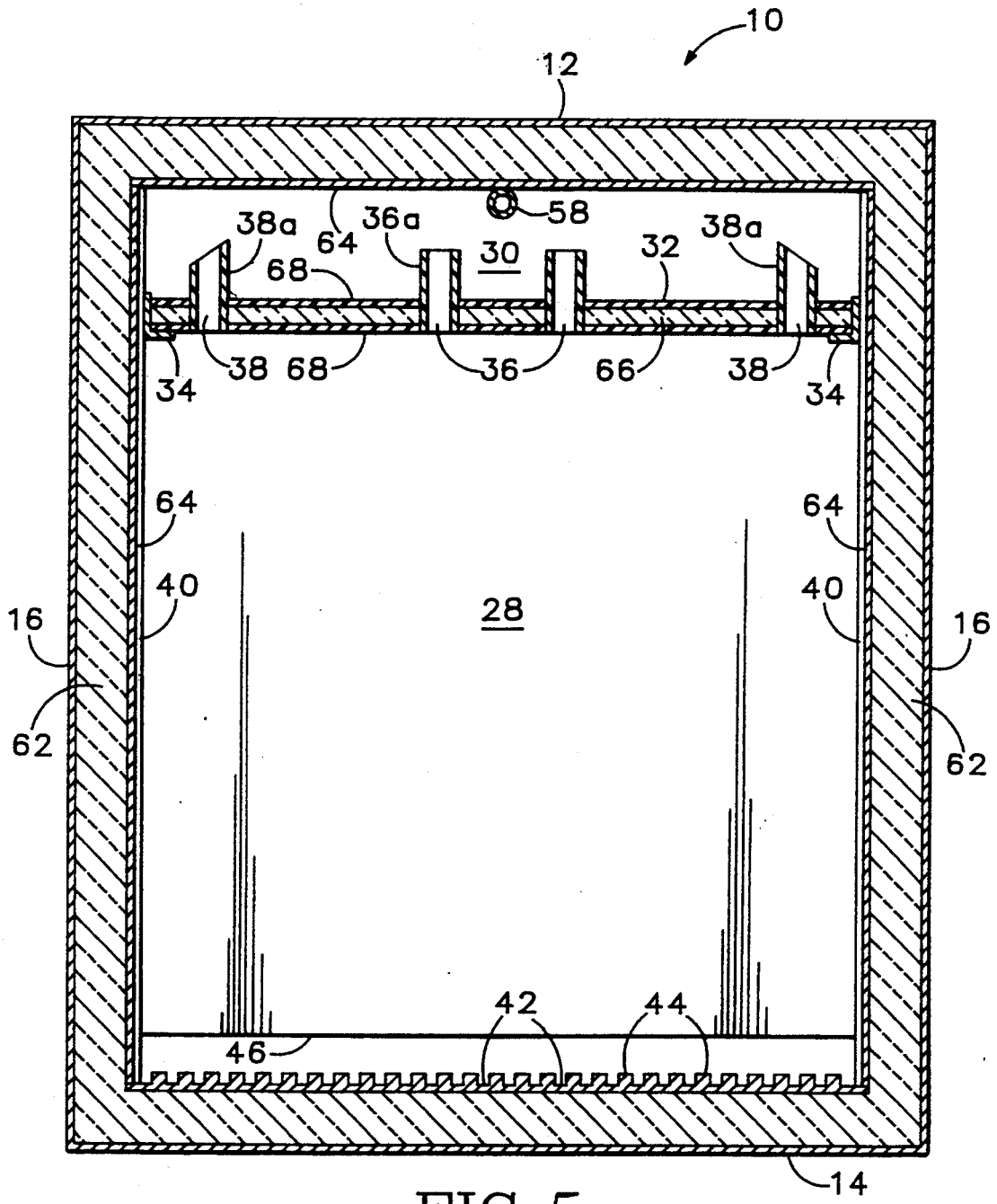
FIG. 5 is an enlarged cross-sectional view taken along line 5—5 of FIG. 1.
Figure 6:
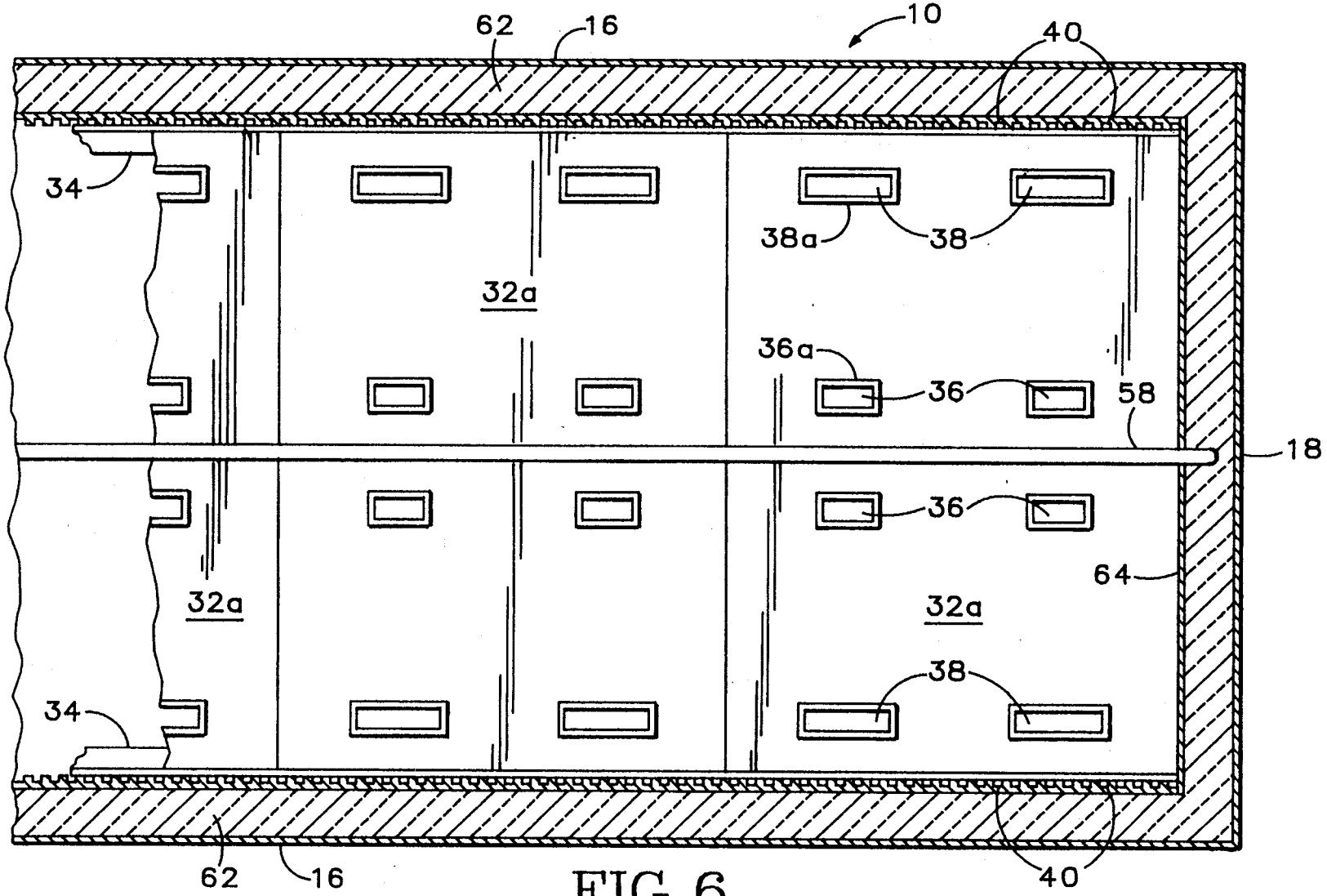
FIG. 6 is an enlarged partial sectional view taken along line 6—6 of FIG. 1.
Figure 7:
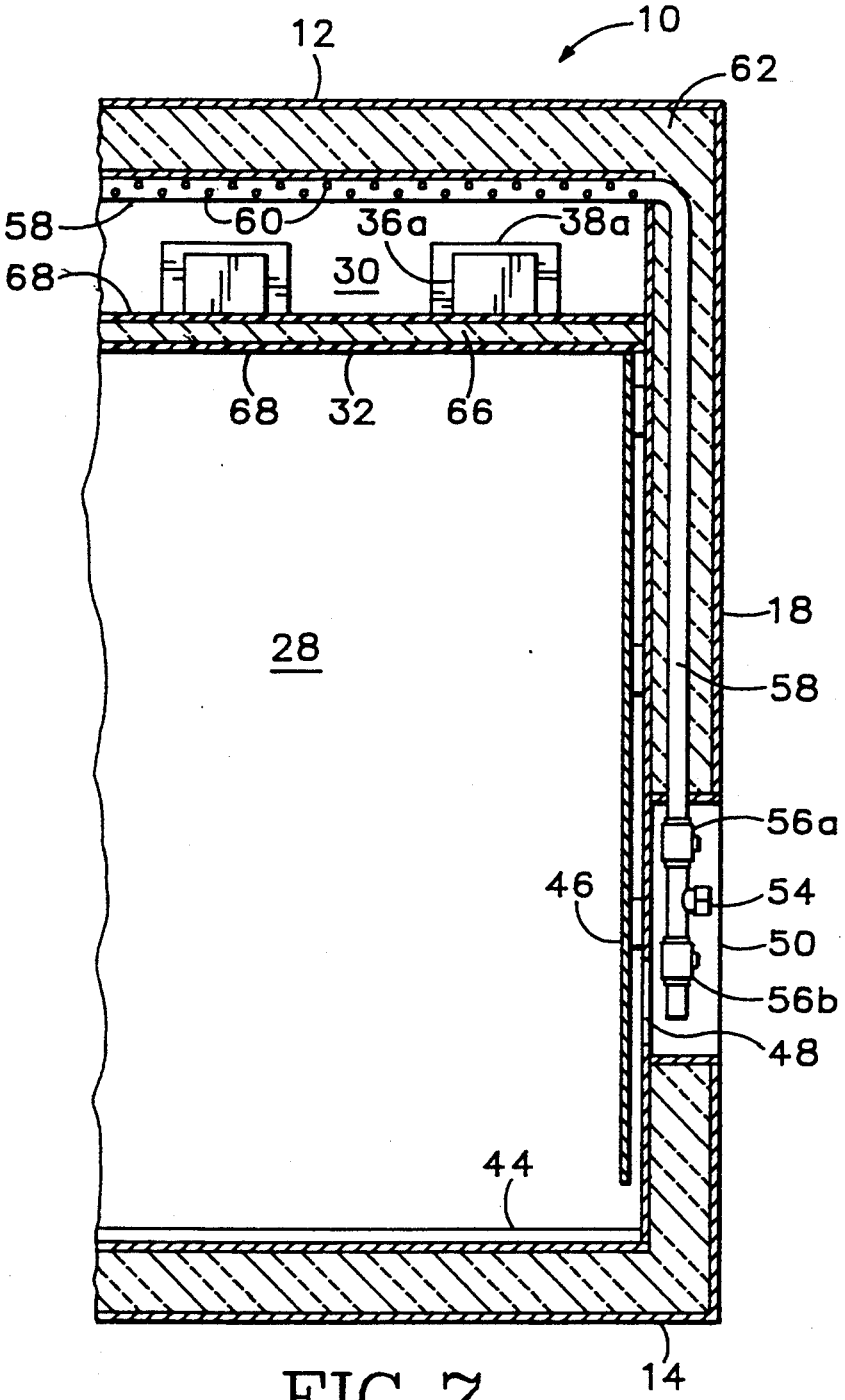
FIG. 7 is an enlarged partial sectional view taken along line 7—7 of FIG. 3.

With reference to FIGS. 5, 6 and 7, the container 10 comprises a thermally insulated enclosure having a cargo-enclosing portion 28, constituting the majority of the volume of the enclosure, and a carbon dioxide-enclosing bunker portion 30 constituting a minority of the volume of the enclosure. The portions 28 and 30 are separated by a horizontal insulated barrier 32 consisting of multiple bunker floor panels 32*a* (FIG. 6) supported by metal angle channels 34 extending longitudinally along the interior of the container sides. Preferably, the interior vertical height of the bunker portion 30 is about 13 inches. Each panel 32*a* has apertures 36, 38 formed therein for venting carbon dioxide gas from the bunker portion 30 into the cargo-enclosing portion 28, both rapidly during the initial injection of carbon dioxide into the bunker portion 30 as described hereafter, and then gradually thereafter during the storage period as the solid carbon dioxide in the bunker portion 30 sublimates. As the carbon dioxide gas is vented from the bunker portion 30 into the cargo-enclosing portion 28 through the venting apertures 36, 38, the gas flows down the interior sides of the container through a series of vertical channels 40 (FIG. 6) approximately ½ inch in depth, and beneath the cargo through longitudinally-extending channels 42 formed between dividers 44 approximately 1 inch in height. The channels 42 and dividers 44 are preferably part of a commercially available standard refrigeration floor such as that manufactured by Alumax Extrusions, Inc. of Yankton, S.D. After flowing around the sides and bottom of the cargo, and thus cooling the cargo, the carbon dioxide gas is exhausted at the end 18 of the container by passing behind a baffle 46 (FIG. 7) and thence to the exterior of the container through an exhaust vent 48 formed in a carbon dioxide charging and venting assembly 50 mounted in the end 18.

Figure 1:
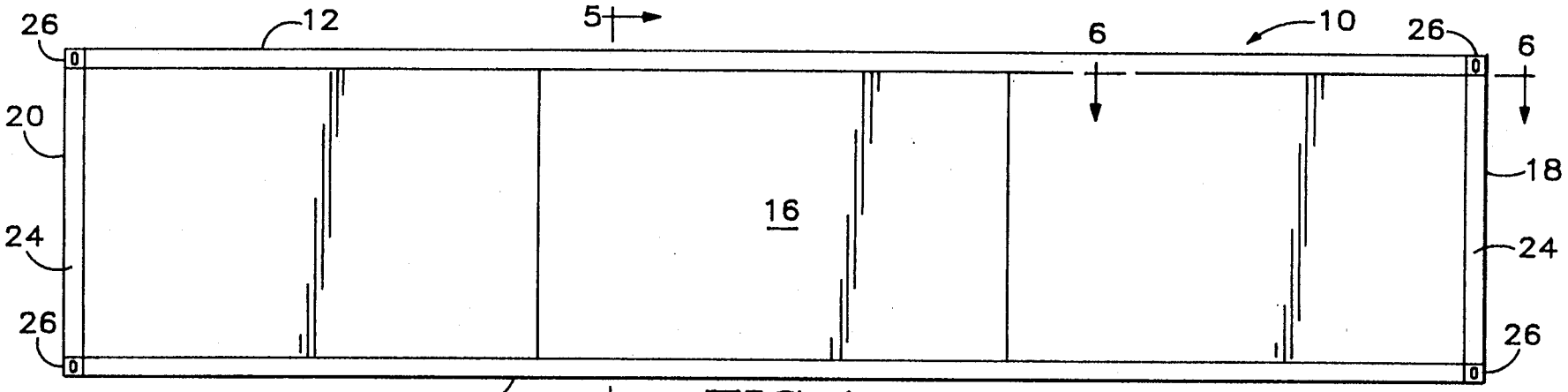
FIG. 1 is a side view of an exemplary embodiment of a stackable cargo-carrying container constructed in accordance with the present invention.
Figure 3:
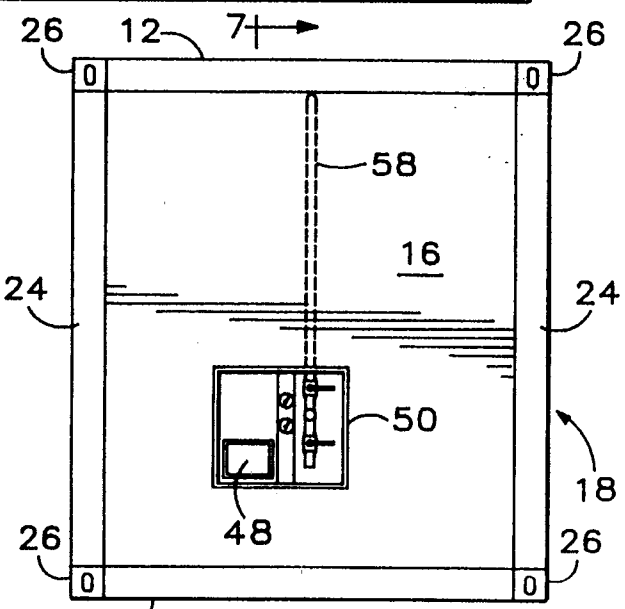
FIG. 3 is an enlarged opposite end view of the container of FIG. 1, showing a carbon dioxide charging and venting assembly.
Figure 4:
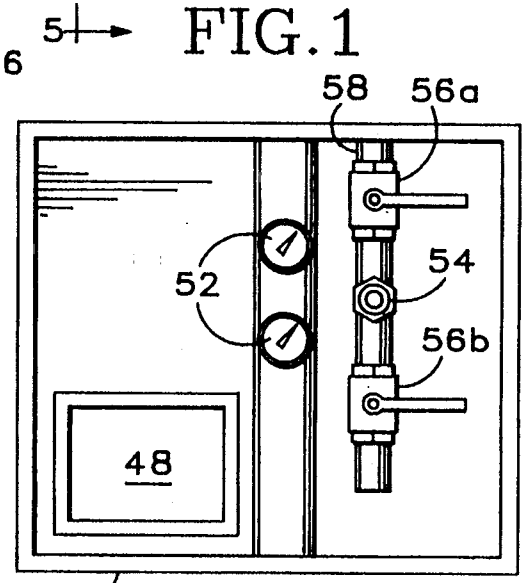
FIG. 4 is an enlarged detail view of the charging and venting assembly shown in FIG. 3.
Figure 2:
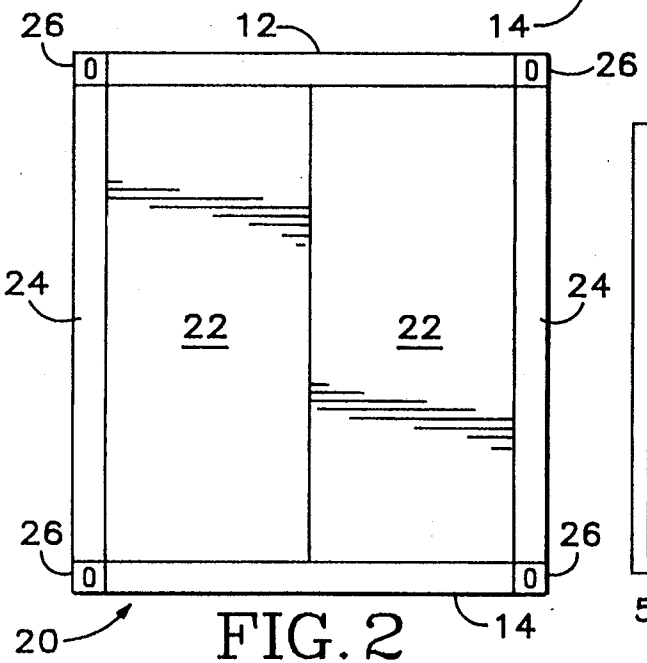
FIG. 2 is an enlarged end view of the container of FIG. 1, showing the entry doors for loading the container.

As shown in FIGS. 3 and 4, the charging and venting assembly 50 also includes temperature gauges such as 52 for monitoring the interior temperature of the container 10, and a carbon dioxide injection fitting 54 communicating between a pair of ball valves 56*a* and 56*b* with a copper loading pipe 58 approximately 1½ inches in diameter. A portion of the pipe 58 extending longitudinally centrally along the interior surface of the roof 12 of the container 10 contains spaced perforations 60 (FIG. 7) for injecting carbon dioxide into the bunker portion 30. After a cargo has been loaded into the container 10, and the doors 22 closed, a source of liquid carbon dioxide under pressure is connected to the fitting 54 with the upper valve 56*a* open and the lower valve 56*b* closed. Thereafter, as the carbon dioxide flows through the pipe 58 and through the perforations 60 into the bunker portion 30, approximately half of it flashes to gas which is vented through the apertures 36, 38, channels 40 and channels 42 around the cargo and out the exhaust vent 48, while the remainder of the carbon dioxide is deposited as solid carbon dioxide particles onto the upper surfaces of the barrier panels 32*a*. Preferably, dams 36*a* and 38*a* are provided around the respective apertures 36, 38 to prevent the solid carbon dioxide particles from clogging the apertures and hindering proper venting, as disclosed in Thomsen U.S. Pat. No. 4,891,954, which is incorporated herein by reference. The maintenance of adequate venting is extremely important, especially during the initial carbon dioxide injection procedure, to prevent excessive pressure within the bunker portion 30. Such excessive pressure can fracture the bunker floor panel 32*a* and alter the critical heat transfer characteristics of the container between the portion 28 and the portion 30, thereby preventing the maintenance of proper refrigeration. In addition, even with the clogging prevention afforded by the dams 36*a* and 38*a*, to ensure the absence of panel fracture during the initial carbon dioxide injection procedure the rate of carbon dioxide injection should be no greater than 0.42 pounds of liquid carbon dioxide per minute per square inch of combined vent apertures 36, 38 for panels 32*a* constructed as described hereafter.

Although the thermal insulation provided in the top, bottom, sides and ends of the container 10 may vary, such insulation preferably comprises polyurethane foam 62 having a thickness of 6 inches on the top, bottom and ends of the container 10, with similar insulation 5 inches in thickness along the sides. The foam 62 is preferably of a closed-cell type resistant to water absorption and having a density of approximately two pounds per cubic foot. The foam may be applied by spraying or pouring. Alternatively, a polystyrene closed-cell foam could be used. The interior sides of the foam insulation are preferably finished with fiberglass reinforced plastic sheets 64.

The structure of the bunker panels **32*a* is a critical factor in determining whether refrigeration of the cargo can be maintained over extended storage durations using a finite initial injection of solid carbon dioxide which is not replenished during the storage duration. In accordance with the present invention, the thermal insulation of the panels 32*a* and combined area of the apertures 36, 38 should be such as to provide a rate of heat transfer across the barrier 32 greater than the rate at which heat is transferred from the cargo to the carbon dioxide gas vented into the cargo-containing portion of the container after completion of initial injection of the carbon dioxide into the bunker portion 30, but at a rate no greater than 0.08 BTU per hour per square foot of area of the barrier per degree Fahrenheit of temperature difference between the two sides of the barrier 32**. Rates of heat transfer below this range, due to excessive insulation, are likely to provide insufficient cooling of the cargo by the carbon dioxide, while rates of heat transfer above this range, due to insufficient insulation, are likely to refrigerate the cargo for too short a duration due to an excessive rate of sublimation of the solid carbon dioxide. Rates of heat transfer within this range will enable sublimation of the solid carbon dioxide to continue over a duration of at least 15 days before the solid carbon dioxide is exhausted, enabling refrigeration durations of up to 30 days or more.

When major areas of the container's exterior, particularly the sides and/or bottom, are not abutting other similar containers but rather are exposed to the environment, it is further preferable that the heat transfer through the insulated barrier 32 from the cargo-enclosing portion 28 to the bunker portion 30 be at an average time rate over the duration of storage which is less than the average time rate over the same duration at which heat is transferred from outside of the container into the cargo-enclosing portion 28.

In order to achieve the foregoing objectives in the exemplary container 10 each of the panels **32*a* of the barrier 32 is preferably constructed of closed-cell polyurethane foam 66 (sprayed or poured) having a density of two pounds per cubic foot and a thickness of 2 inches, sandwiched between a pair of fiberglass-reinforced plastic sheets 68, each sheet having a thickness of 3/16 inch. Each sheet is preferably finished on both sides with white gelcoat, except for the upper surface of the panels 32*a* which are finished with plain resin. Each panel 32*a*, of which there are a total of ten, is 48×84 inches and has four venting apertures 36 which are 3×6 inches and four venting apertures 38** which are 3×10 inches.

In use, the container 10 may, for example, be loaded with 42,000–43,000 pounds of frozen french fries, or with any other frozen food, the doors 22 closed, and 22,000 pounds of liquid carbon dioxide initially injected into the bunker portion 30 through the pipe 58 at a rate preferably not exceeding about 800 pounds of liquid per minute to avoid fracture of the panels **32*a*. During initial injection, approximately half of the carbon dioxide flashes to gas which is exhausted through the venting apertures 36, 38 into the cargo-enclosing portion 28 from which it flows around and under the cargo to the exterior of the container through the exhaust vent 48. After initial carbon dioxide injection has been completed, the upper valve 56*a* is closed and the container 10 may be transported for durations of 30 days or more without further attention while maintaining the cargo in an adequately-refrigerated condition even if all outer surfaces of the container are exposed to ambient temperature. Alternatively, if multiple such containers are stacked atop one another and alongside one another in close proximity as shown in FIG. 8**, significantly longer durations of refrigeration are obtainable from the same initial amount of carbon dioxide in each container.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method of maintaining a cargo in a refrigerated condition over an extended duration, said method comprising:

(a) providing an insulated enclosure having a cargo-enclosing portion comprising a majority of the volume of said enclosure, and a carbon dioxide-enclosing portion comprising a minority of the volume of said enclosure;

(b) providing an insulated barrier between said cargo-enclosing portion and said carbon dioxide-enclosing portion;

(c) at the beginning of said duration, placing said cargo in said cargo-enclosing portion and placing solid carbon dioxide in said carbon dioxide-enclosing portion;

(d) after step (c) has been completed, converting said solid carbon dioxide in said carbon dioxide-enclosing portion to a carbon dioxide gas while transferring heat from outside of said enclosure into said cargo-enclosing portion;

(e) simultaneously with step (d), venting said carbon dioxide gas from said carbon dioxide-enclosing portion into said cargo-enclosing portion to thereby transfer heat from within said cargo-enclosing portion to said carbon dioxide gas; and (f) simultaneously with step (d), transferring heat from within said cargo-enclosing portion through said insulated barrier into said carbon dioxide-enclosing portion at a rate greater than the rate at which heat is transferred to said carbon dioxide gas in step (e), but at a rate no greater than 0.08 BTU per hour per square foot of area normal to the transfer of said heat, per degree Fahrenheit of temperature difference between said cargo-enclosing portion and said carbon dioxide-enclosing portion measured at respective locations immediately adjacent to said barrier; and (g) performing steps (d), (e) and (f) over a duration of at least 15 days.

2. The method of claim 1, including the step of providing multiple insulated enclosures as described in step (a), each enclosure comprising a cargo-carrying container of generally rectangular shape, and stacking said enclosures vertically atop one another.

3. The method of claim 1, including the step of providing multiple insulated enclosures as described in step (a), each enclosure comprising a cargo-carrying container of generally rectangular shape, and placing said enclosures side by side in close proximity to each other.

4. The method of claim 1 wherein step (f) includes transferring heat from said cargo-enclosing portion through said insulated barrier into said carbon dioxide-enclosing portion at an average time rate over said duration which is less than the average time rate over said duration at which heat is transferred from outside said enclosure into said cargo-enclosing portion in step (d).

5. A method of maintaining a cargo in a refrigerated condition over an extended duration, said method comprising:

(a) providing at least a pair of insulated cargo-carrying containers of generally rectangular shape stackable vertically atop one another, each container having a cargo-enclosing portion comprising a majority of the volume of said container, and a carbon dioxide-enclosing portion comprising a minority of the volume of said container;

(b) providing an insulated barrier between said cargo-enclosing portion and said carbon dioxide-enclosing portion of each container;

(c) at the beginning of said duration, placing said cargo in said cargo-enclosing portion of each container and placing solid carbon dioxide in said carbon dioxide-enclosing portion of each container;

(d) after step (c) has been completed, converting said solid carbon dioxide in said carbon dioxide-enclosing portion of each container to a carbon dioxide gas while transferring heat from outside of each container into said cargo-enclosing portion of each container;

(e) simultaneously with step (d), venting said carbon dioxide gas from said carbon dioxide-enclosing portion of each container into said cargo-enclosing portion of each container to thereby transfer heat from within said cargo-enclosing portion to said carbon dioxide gas; and (f) performing steps (d) and (e) over a duration of at least 15 days.

6. The method of claim 5, including orienting said insulated barrier substantially horizontally across the interior of said container adjacent the top thereof.

7. The method of claim 5, including stacking at least one of said containers atop another of said containers.

8. The method of claim 5, including placing said containers side by side in close proximity to each other.

9. The method of claim 5, including, simultaneously with step (d), transferring heat from within said cargo-enclosing portion through said insulated barrier into said carbon dioxide-enclosing portion of each container at a rate greater than the rate at which heat is transferred to said carbon dioxide gas in step (e), but at a rate no greater than 0.08 BTU per hour per square foot of area normal to the transfer of said heat, per degree Fahrenheit of temperature difference between said cargo-enclosing portion and said carbon dioxide-enclosing portion measured at respective locations immediately adjacent to said barrier.

10. The method of claim 5, including transferring heat from said cargo-enclosing portion through said insulated barrier into said carbon dioxide-enclosing portion of at least one of said containers at an average time rate over said duration which is less than the average time rate over said duration at which heat is transferred from outside said one of said containers into said cargo-enclosing portion in step (d).

* * * * *